US009531059B2

(12) United States Patent
Iellici et al.

(10) Patent No.: US 9,531,059 B2
(45) Date of Patent: Dec. 27, 2016

(54) SIDE FACE ANTENNA FOR A COMPUTING DEVICE CASE

(71) Applicant: Microsoft Corporation, Redmond, WA (US)

(72) Inventors: Devis Iellici, Cambridge (GB); Marc Harper, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 227 days.

(21) Appl. No.: 14/090,542

(22) Filed: Nov. 26, 2013

(65) Prior Publication Data

US 2014/0347227 A1 Nov. 27, 2014

Related U.S. Application Data

(60) Provisional application No. 61/827,421, filed on May 24, 2013, provisional application No. 61/827,372, filed on May 24, 2013.

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/2266* (2013.01); *H01Q 5/378* (2015.01); *H01Q 5/40* (2015.01); *H01Q 9/42* (2013.01); *Y10T 29/49016* (2015.01)

(58) Field of Classification Search
CPC ..... H01Q 1/243; H01Q 13/10; H01Q 1/2266; H01Q 5/371; H01Q 9/42
(Continued)

(56) References Cited

U.S. PATENT DOCUMENTS 4,518,965 A 5/1985 Hidaka
4,625,212 A * 11/1986 Oda ..... H01Q 1/243 343/702
(Continued)

FOREIGN PATENT DOCUMENTS

EP 2405534 A1 11/2012
GB 2409345 A 6/2005
(Continued)

OTHER PUBLICATIONS

Petosa, A. et al, "Dielectric Resonator Antennas: A Historical Review and the Current State of Art", Antennas and Propagation Magazine, IEEE, (vol. 52, Issue 5) Oct. 2010, pp. 91-116.
(Continued)

*Primary Examiner* — Tho G. Phan
(74) *Attorney, Agent, or Firm* — Brandon Roper; Judy Yee; Micky Minhas

(57) ABSTRACT

An antenna assembly includes a portion of the metal computing device case as a primary radiating structure. The metal computing device case includes a back face and four side faces bounding at least a portion of the back face. The metal computing device case further includes a radiating structure having an aperture formed in the back face from which a notch extends from the aperture cutting through the back face and through at least one side face of the metal computing device case. A conductive feed structure is connected to a radio. The conductive feed structure is connected to or positioned proximal to the radiating structure of the metal computing device case and is configured to excite the radiating structure at one or more resonance frequencies.

20 Claims, 14 Drawing Sheets

(51) Int. Cl.
*H01Q 9/42* (2006.01)
*H01Q 5/378* (2015.01)
*H01Q 5/40* (2015.01)

(58) Field of Classification Search
USPC ..... 343/702; 29/600
See application file for complete search history.

(56) References Cited

U.S. PATENT DOCUMENTS

| | | | | |
|---|---|---|---|---|
| 6,348,897 | B1 | 2/2002 | Alameh et al. | |
| 6,642,891 | B2 | 11/2003 | Baro | |
| 6,650,294 | B2 | 11/2003 | Ying et al. | |
| 7,084,814 | B2 * | 8/2006 | Chen | H01Q 9/0421 343/700 MS |
| 7,132,987 | B1 * | 11/2006 | Olsson | H01Q 1/243 343/702 |
| 7,215,283 | B2 * | 5/2007 | Boyle | H01Q 1/243 343/700 MS |
| 7,321,337 | B2 | 1/2008 | Ikeda et al. | |
| 7,342,540 | B2 | 3/2008 | Nahar et al. | |
| 7,535,421 | B2 | 5/2009 | Tseng et al. | |
| 7,545,327 | B2 | 6/2009 | Iellici et al. | |
| 7,671,804 | B2 | 3/2010 | Zhang et al. | |
| 7,705,786 | B2 | 4/2010 | Iellici | |
| 8,125,772 | B2 | 2/2012 | Kim | |
| 8,269,677 | B2 | 9/2012 | Guterman et al. | |
| 8,410,985 | B2 | 4/2013 | Mercer et al. | |
| 8,644,012 | B2 | 2/2014 | Lee | |
| 8,648,752 | B2 * | 2/2014 | Ramachandran | H01Q 1/24 343/700 MS |
| 8,963,785 | B2 | 2/2015 | Dong et al. | |
| 9,070,969 | B2 | 6/2015 | Mow et al. | |
| 9,196,952 | B2 | 11/2015 | Tran et al. | |
| 9,197,270 | B2 | 11/2015 | Ying et al. | |
| 9,287,612 | B2 | 3/2016 | Bolin et al. | |
| 2003/0201945 | A1 | 10/2003 | Reece et al. | |
| 2004/0041734 | A1 * | 3/2004 | Shiotsu | G06F 1/1616 343/702 |
| 2004/0222925 | A1 | 11/2004 | Fabrega-Sanchez et al. | |
| 2004/0257283 | A1 | 12/2004 | Asano et al. | |
| 2005/0085204 | A1 | 4/2005 | Poilasne et al. | |
| 2005/0146475 | A1 | 7/2005 | Bettner et al. | |
| 2006/0244663 | A1 | 11/2006 | Fleck et al. | |
| 2007/0120740 | A1 | 5/2007 | Iellici et al. | |
| 2007/0210969 | A1 | 9/2007 | Vance | |
| 2008/0316115 | A1 * | 12/2008 | Hill | H01Q 1/243 343/702 |
| 2009/0153412 | A1 * | 6/2009 | Chiang | H01Q 1/52 343/702 |
| 2010/0053002 | A1 | 3/2010 | Wojack et al. | |
| 2010/0214180 | A1 | 8/2010 | Krogerus | |
| 2010/0231481 | A1 | 9/2010 | Chiang et al. | |
| 2010/0321253 | A1 | 12/2010 | Vazquez et al. | |
| 2011/0136447 | A1 | 6/2011 | Pascolini et al. | |
| 2011/0241949 | A1 | 10/2011 | Nickel et al. | |
| 2012/0154223 | A1 | 6/2012 | Oh et al. | |
| 2012/0176280 | A1 | 7/2012 | Chen et al. | |
| 2012/0274522 | A1 | 11/2012 | Ayatollahi | |
| 2013/0021212 | A1 | 1/2013 | Lai et al. | |
| 2013/0082884 | A1 | 4/2013 | Gummalla | |
| 2013/0135150 | A1 | 5/2013 | Kenoun et al. | |
| 2013/0169486 | A1 | 7/2013 | Huang et al. | |
| 2013/0194138 | A1 * | 8/2013 | Hammond | H01Q 13/10 343/702 |
| 2014/0203974 | A1 | 7/2014 | Liu et al. | |
| 2014/0347225 | A1 | 11/2014 | Harper | |
| 2014/0347226 | A1 | 11/2014 | Iellici et al. | |

FOREIGN PATENT DOCUMENTS

| | | | |
|---|---|---|---|
| GB | 2410131 | A | 7/2005 |
| GB | 2476035 | A | 6/2011 |
| JP | 2007194995 | A | 8/2007 |
| WO | 2004091046 | A1 | 10/2004 |
| WO | 2005091430 | | 9/2005 |
| WO | 2006134402 | | 12/2006 |
| WO | 2010025023 | A2 | 3/2010 |

OTHER PUBLICATIONS

Lee, T.H. et al, "New Dielectric Resonator Antenna Design for Mobile Handsets", Mobile & Satellite Communications Research Center, University of Bradford, Bradford BD7 1DP, UK; www.researchgate.net/publication 228992335.

"International Preliminary Report on Patentability Issued in PCT Application No. PCT/US2014/039416", Mailed Date: Aug. 3, 2015, 6 Pages.

International Searching Authority, U.S. Patent and Trademark Office, International Search Report for PCT/US2014/039421, dated Aug. 14, 2014, 6 pages.

Nternational Searching Authority, U.S. Patent and Trademark Office, Written Opinion for PCT/US2014/039421, mailed Aug. 22, 2014, 7 pages.

"International Preliminary Report on Patentability Issued in PCT Patent Application No. PCT/US2014/039421", Mailed Date: Sep. 4, 2015, 6 Pages.

"International Search Report and Written Opinion Received for Patent Application No. PCT/US2014/039416", Mailed Date: Sep. 19, 2014, 14 Pages.

Non-Final Office Action issued in U.S. Appl. No. 14/090,465, dated Nov. 10, 2015, 17 pages.

Non-Final Office Action issued in U.S. Appl. No. 14/090,465, dated Mar. 28, 2016, 10 pages.

Non-Final Office Action issued in U.S. Appl. No. 14/090,353, dated Jan. 4, 2016, 17 pages.

International Searching Authority, U.S. Patent and Trademark Office, Second Written Opinion for PCT/US2014/039426, mailed Apr. 14, 2015, 6 pages.

International Searching Authority, U.S. Patent and Trademark Office, Second Written Opinion for PCT/US2014/039421, mailed Apr. 21, 2015, 8 pages.

International Preliminary Report on Patentability Issued in PCT Application No. PCT/US2014/039426, mailed Aug. 3, 2013, 7 pages.

International Search Report & Written Opinion for PCT/US2014/039426, mailed Sep. 10, 2014, 14 pages.

* cited by examiner

SIDE FACE ANTENNA FOR A COMPUTING DEVICE CASE

CROSS-REFERENCE TO RELATED APPLICATIONS

The present application claims benefit to U.S. Provisional Application No. 61/827,372 filed on May 24, 2013, and entitled "Back Face Antenna for a Computing Device Case," and U.S. Provisional Application No. 61/827,421, filed on May 24, 2013, and entitled "Side Face Antenna for a Computing Device Case," both of which are specifically incorporated by reference for all that they disclose and teach.

The present application is also related to U.S. application Ser. No. 14/090,465, filed concurrently herewith and entitled "Back Face Antenna in a Computing Device Case,", and U.S. application Ser. No. 14/090,353 filed concurrently herewith and entitled "Radiating Structure Formed as a Part of a Metal Computing Device Case", both of which are specifically incorporated by reference for all that it discloses and teaches.

BACKGROUND

Antennas for computing devices present challenges relating to receiving and transmitting radio waves at one or more select frequencies. These challenges are magnified by a current trend of housing such computing devices (and their antennas) in metal cases, as the metal cases tend to shield incoming and outgoing radio waves. Some attempted solutions to mitigate this shielding problem introduce structural and manufacturing challenges into the design of the computing device.

SUMMARY

Implementations described and claimed herein address the foregoing problems by forming an antenna assembly that includes a portion of the metal computing device case as a primary radiating structure. The metal computing device case includes a back face and four side faces bounding at least a portion of the back face. The metal computing device case further includes a radiating structure having an aperture formed in the back face from which a notch extends from the aperture cutting through the back face and through at least one side face of the metal computing device case. A conductive feed structure is connected to a radio. The conductive feed structure is connected to or positioned proximal to the radiating structure of the metal computing device case and is configured to excite the radiating structure at one or more resonance frequencies.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Figure 1:
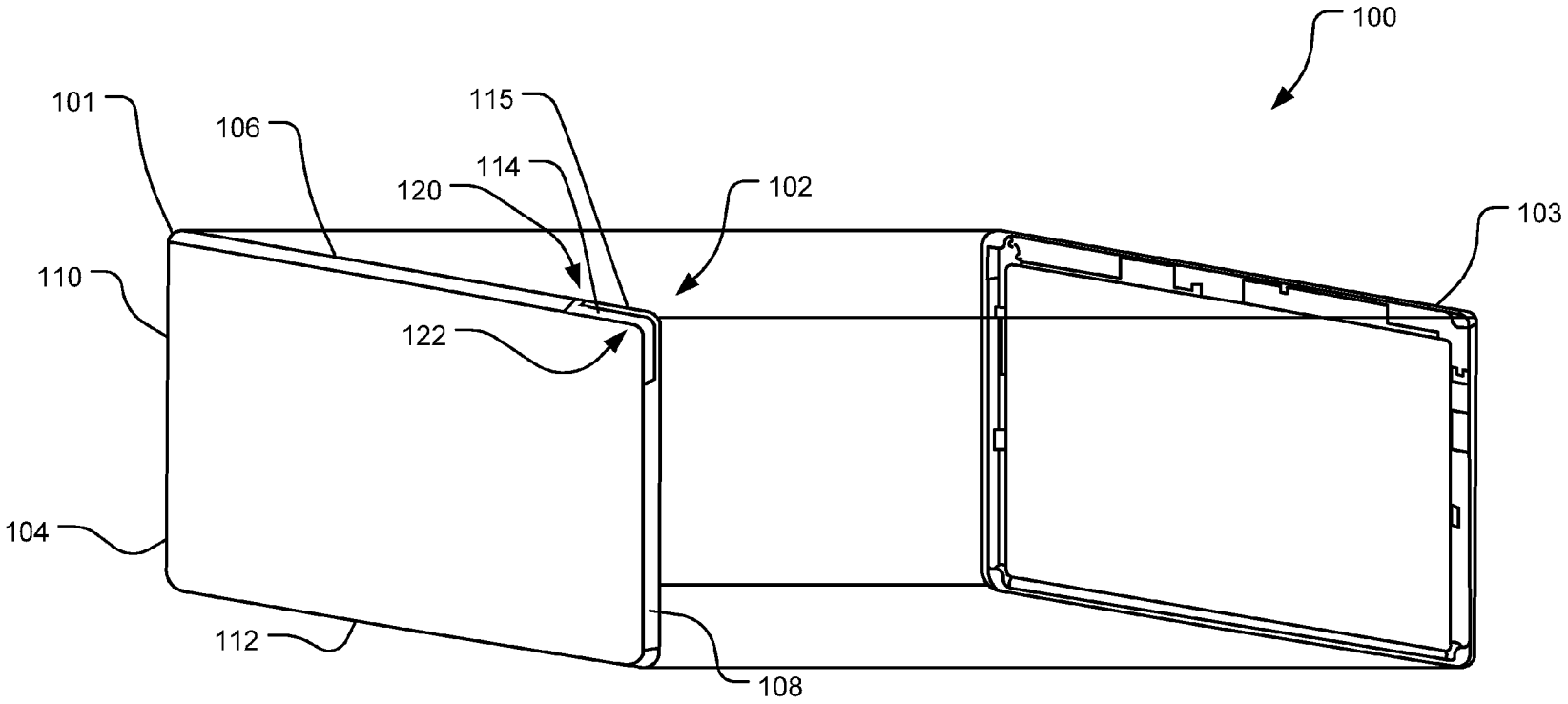
FIG. 1 illustrates two portions of an example metal computing device case having a side face antenna assembly.

FIG. 1 illustrates two portions 101 and 103 of an example computing device case 100 having a side face antenna assembly 102. The portion 103 typically contains the display assembly while the portion 101 typically encloses (at least partially) most other components of the computing device. In the illustrated implementation, the antenna assembly 102 is integrated as part of the metal computing device case 100.

The metal computing device case includes a back face 104 and four side faces 106, 108, 110, and 112 bounding the back face 104. In other implementations, fewer than four sides may partially bound the back face 104. In addition, the back face 104 and one or more of the side faces may be joined at an abrupt corner, at a curved corner (e.g., a continuous arc between the back face and the side face), or in various continuous intersecting surface combinations. Furthermore, the side faces need not be perpendicular to the back face (e.g., a side face may be positioned at an obtuse or acute angle with the back face). In one implementation, the back face and one or more side faces are integrated into a single piece construction, although other assembled configurations are also contemplated.

The side face antenna assembly 102 includes one or more apertures or cut-outs created in one or more of the side faces (in this case, in side faces 106 and 108). Such an aperture may also be referred to as a "slot" 122. In FIG. 1, the slot 122 is shown as L-shaped along two adjacent side faces of the computing device case, although other configurations are contemplated. The side face antenna assembly 102 also includes a notch 120 is cut through an edge portion 115 of the side face 106. The slot 122 and notch 120 form an elongated metal arm from the remaining edges of the side faces 106 and 108. The slot 122 and the notch 120 may operate as a radiating structure and may operate as an antenna in combination with other elements, such as a feed structure. The elongated arm can be excited directly (e.g., galvanically, like a Planar Inverted-F Antenna), capacitively, or via some other excitation method. The slot 122 and notch 120 may be filled with a plastic layer or other insulating material (e.g., a ceramic), as shown with plastic insert 114. Such a radiating structure may be designed to resonate at a particular frequency, and/or, for certain applications, may be designed to radiate very limited, or substantially zero, power at a particular frequency or set of frequencies.

Figure 2:
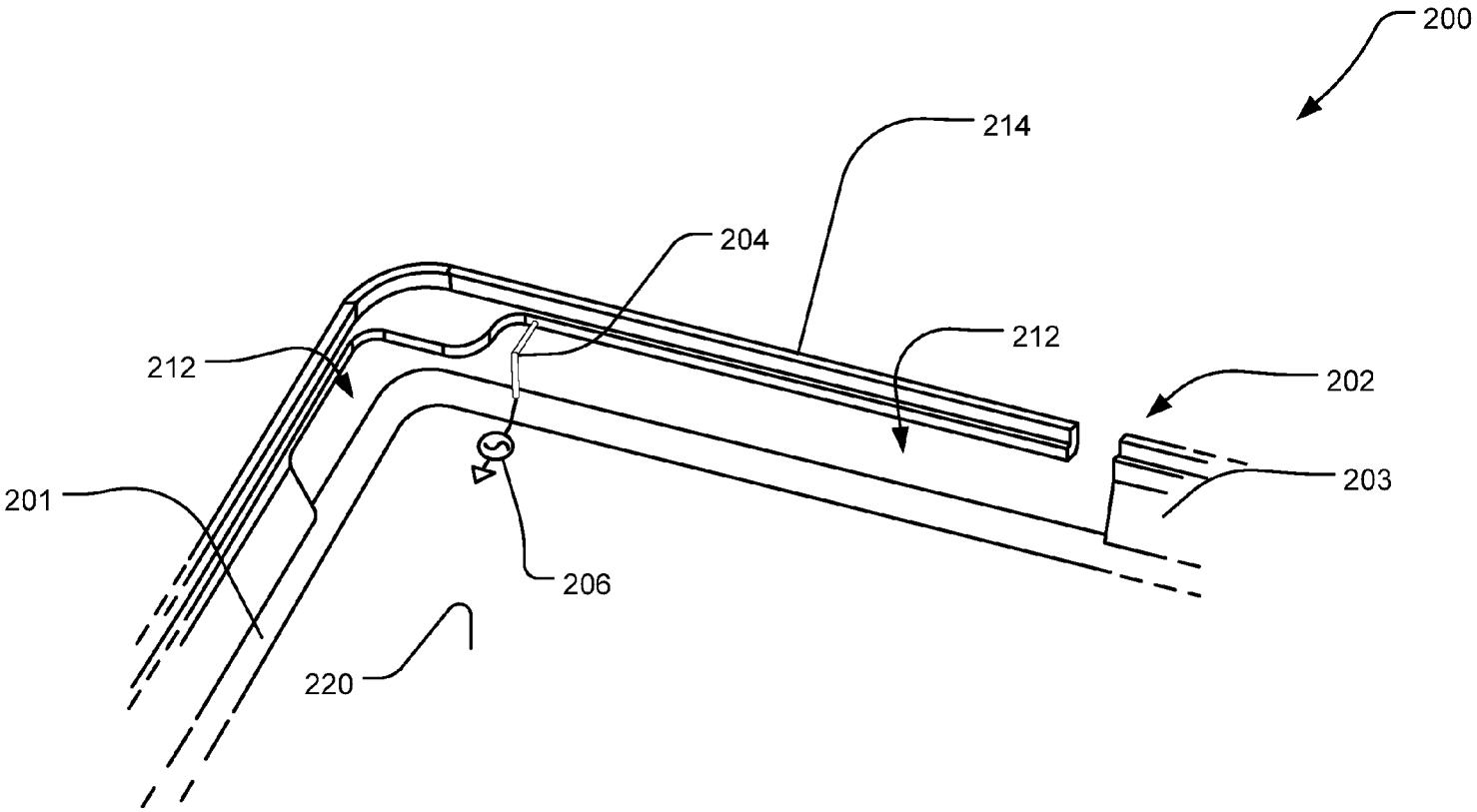
FIG. 2 illustrates an example L-shaped side face antenna assembly with a side face notch.

FIG. 2 illustrates an example L-shaped side face antenna assembly 200 with a side face notch 202 in the edge of the side face 203 of a metal computing device case 201. A feed structure 204 connects a radio 206, located on a printed circuit board (PCB) 220 positioned on the back face of the metal computing device case, to an elongated metal arm 214 formed along an edge of the side faces 208 and 210 by an L-shaped slot 212 and the notch 202. In the illustrated implementation, the length of the elongated metal arm 214 is defined to resonate close to the lowest frequency of antenna operation. The L-shaped slot 212 extends around one corner of the metal computing device case 201, although other configurations may be employed.

It should be understood that multiple notches through the same side face edge or through different side face edges may also be employed. Other cut-out, notch, and feed structure configurations can result in different antenna efficiency bands that may correspond with frequencies used in any radio standard or protocol including without limitation UMTS, GSM, LTE, 4G 3G, 2G WiFi, WiMAX, Bluetooth, Miracast, and other standards or specifications that may be developed in the future.

Figure 3:
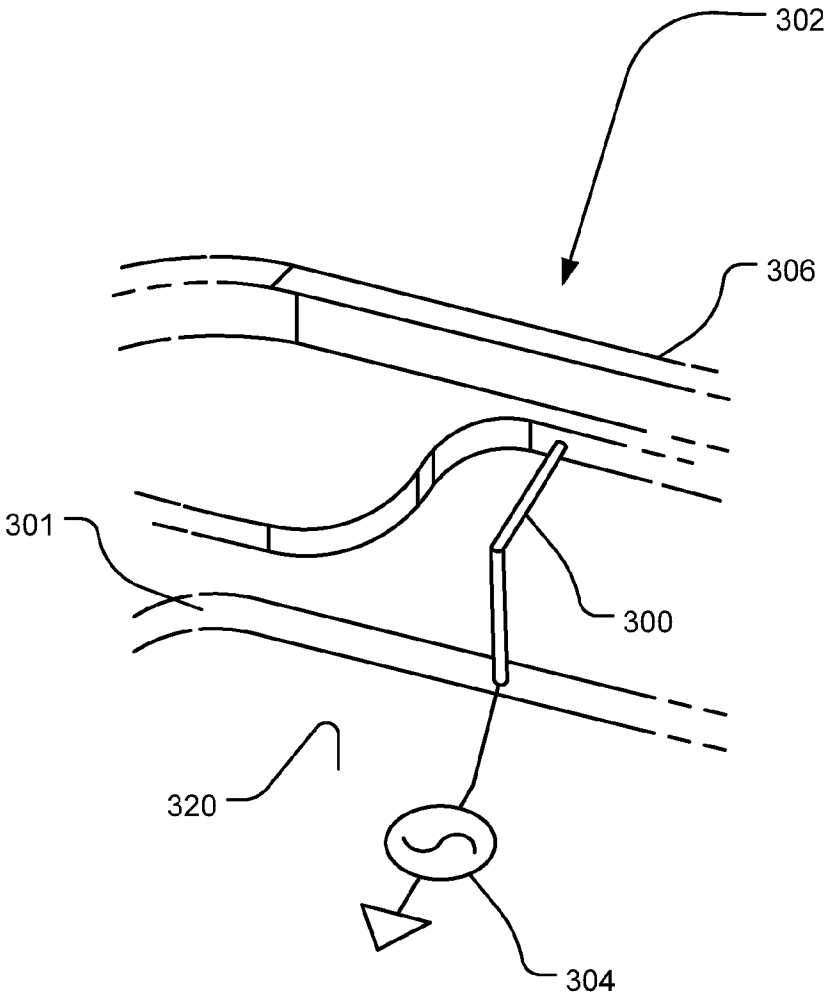
FIG. 3 illustrates an example feed structure for a side face antenna assembly.

FIG. 3 illustrates an example feed structure 300 for a side face antenna assembly 302 of a metal computing device case 301. The feed structure 300 is conductive and electrically connects a radio 304 (e.g., located on a PCB 320) to an elongated metal arm 306 of the side face antenna assembly 302. In other implementations, the feed structure 300 may connect to other locations along the elongated arm 306 and along the PCB 320 on the back face of the metal computing device case 301.

Figure 4:
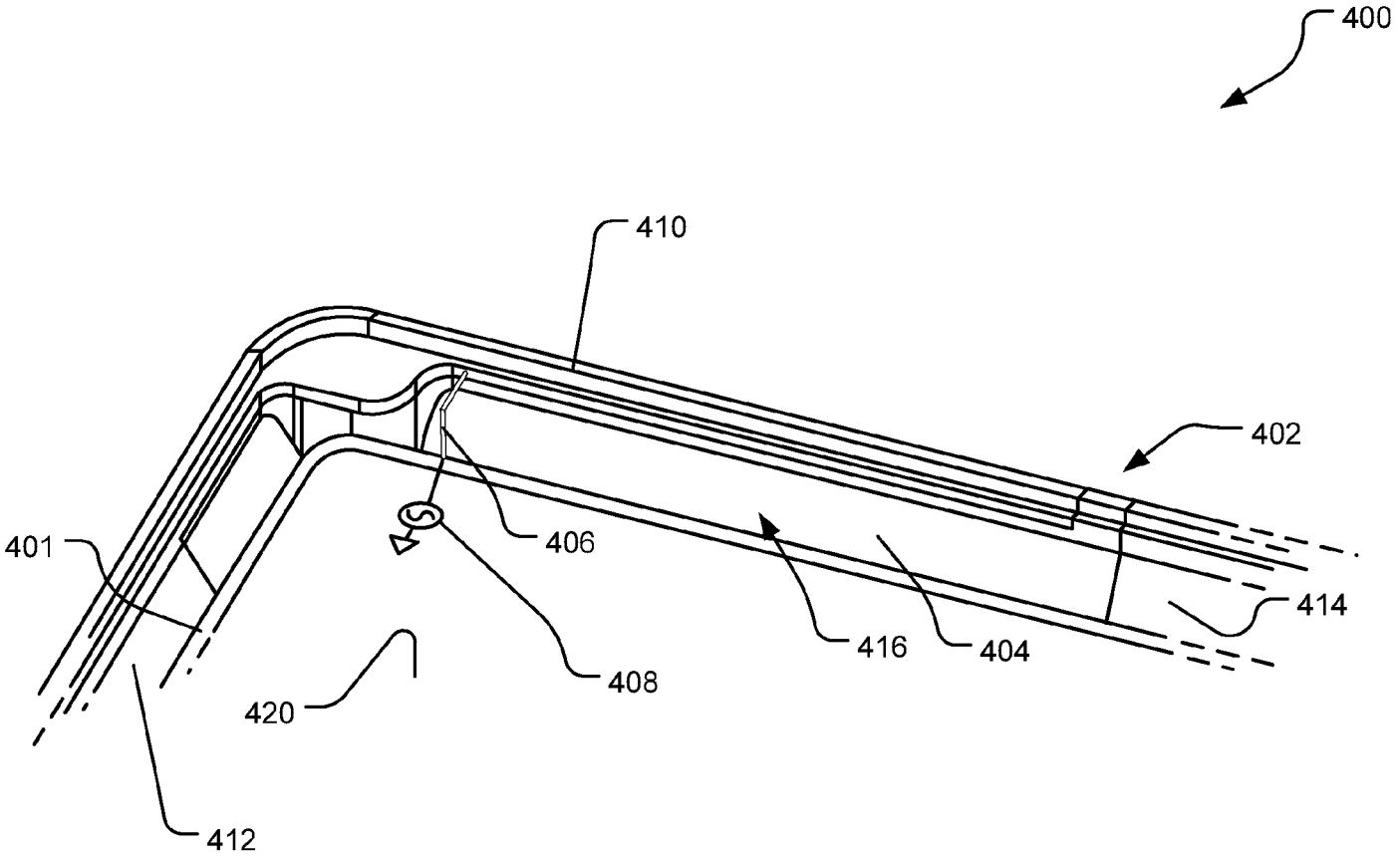
FIG. 4 illustrates an example L-shaped side face antenna assembly with a side face notch and a plastic insert.

FIG. 4 illustrates an example L-shaped side face antenna assembly 400 with a side face notch 402 and a plastic insert 404 filling a slot 416 in a metal computing device case 401. It should be understood that the insert may be made of other insulating materials (e.g., ceramics). A feed structure 406 connects a radio 408 to an elongated metal arm 410 formed along an edge of one of the side faces 412 or 414 by the slot 416 and a notch 402. Typically, the radio 408 is mounted on a PCB 420 within the metal computing device case 401.

The plastic insert 404 can fit into the slot 416 and notch 402. In this configuration, rigidity of the metal computing device 401 can be improved, with a possible trade-off in performance. In an alternative implementation, the insert 404 may be made from a dielectric material having a dielectric constant that can be altered by applying a voltage to the insert 404, thereby tuning the resonance frequency during operation of the computing device.

Figure 5:
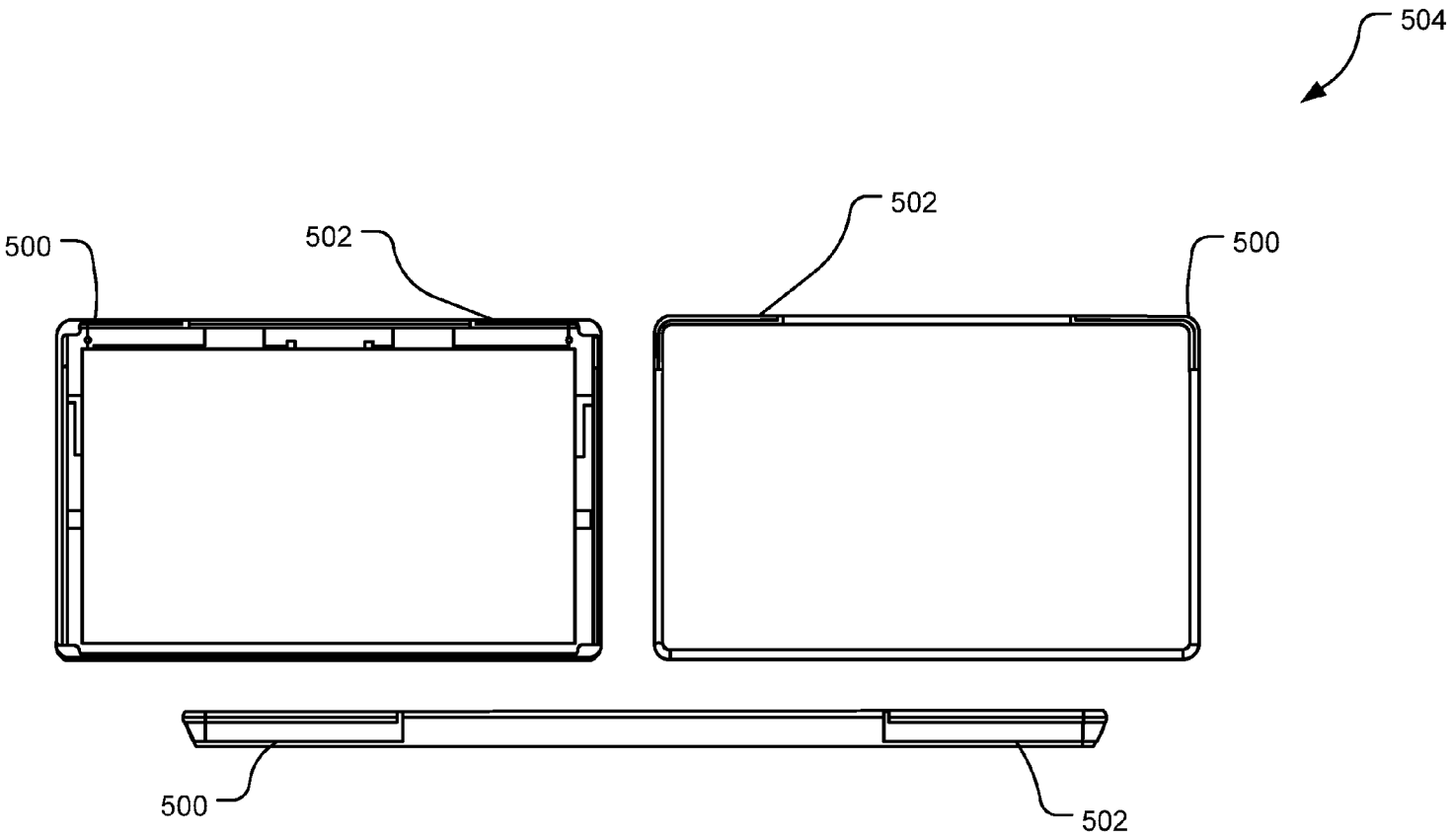
FIG. 5 illustrates multiple views of an example metal computing device case having multiple side face antenna assemblies.

FIG. 5 illustrates multiple views of an example metal computing device case 504 having multiple side face antenna assemblies 500 and 502. It should be understood that more than four side face antenna assemblies may be configured in a single metal computing device case. Multiple antenna assemblies can be employed to provide a diversity/MIMO (multiple-input and multiple-output) configuration.

Figure 6:
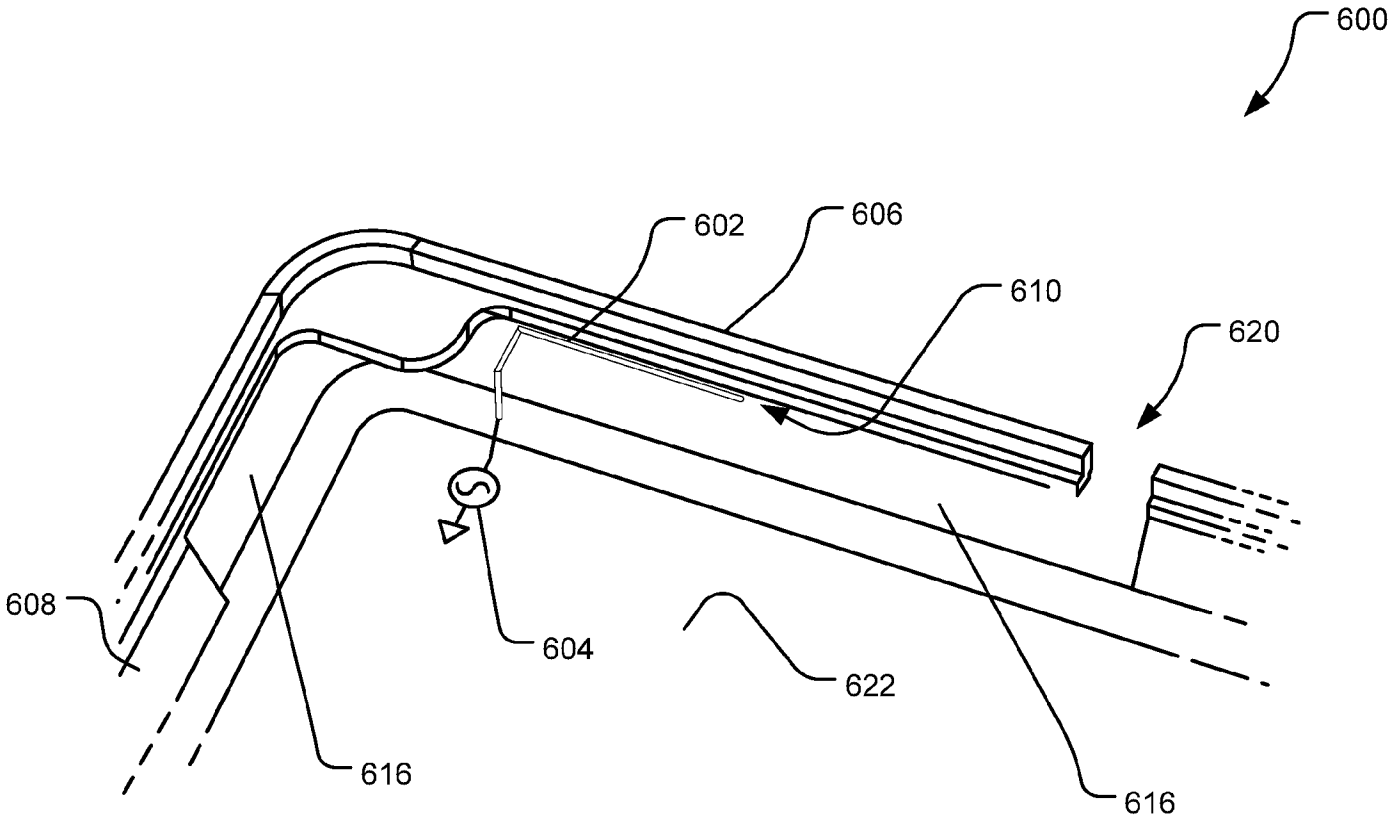
FIG. 6 illustrates an example L-shaped side face antenna assembly with capacitive feeding.

FIG. 6 illustrates an example L-shaped side face antenna assembly 600 with capacitive feeding. A feed structure 602 is conductive and capacitively connects a radio 604 to an elongated metal arm 606 of a metal computing device case 608 through an insulating gap 610. The elongated metal arm 606 is formed along an edge of one of the side faces by the slot 616 and a notch 620. The feed structure 602 may be sized to achieve a particular resonance frequency and matching impedance. For example, the length, width, and/or thickness of each section of the feed structure 602 may be selected to achieve selected resonance frequencies and matching impedances. Further, the material of the feed structure 602 may be selected based on the resistance of a particular material to achieve selected resonance frequencies and matching impedances. Typically, the radio 604 is mounted on a PCB 622 within the metal computing device case 608.

Figure 7:
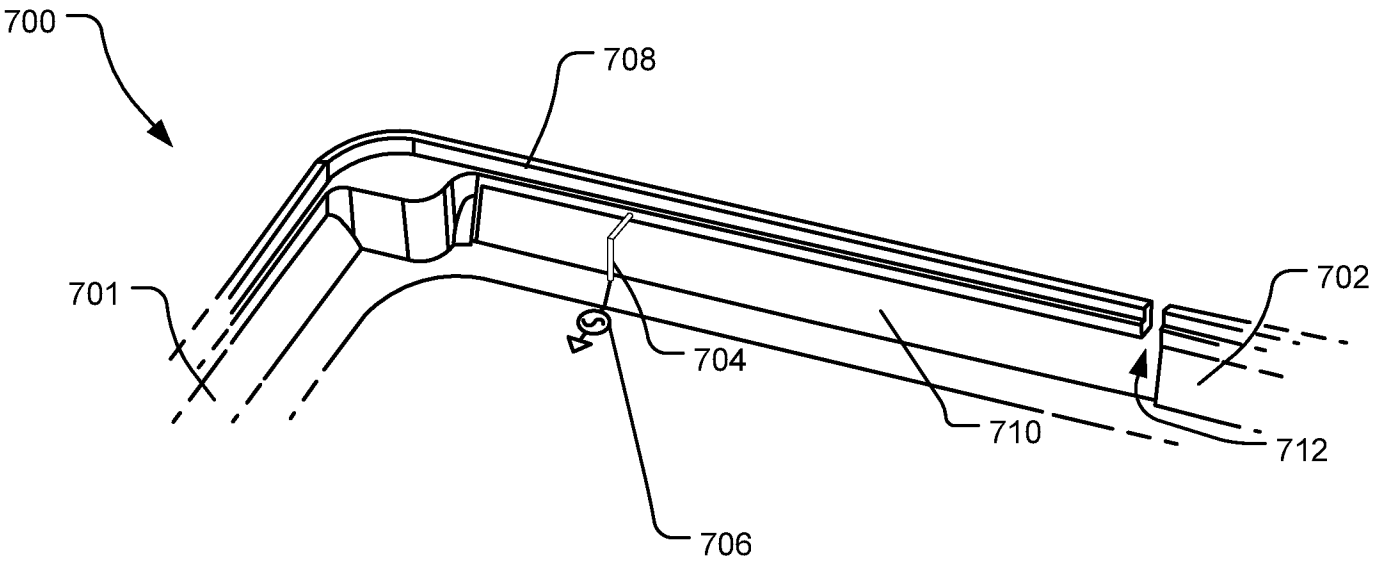
FIG. 7 illustrates an example side face antenna assembly on a single side face.

FIG. 7 illustrates an example side face antenna assembly 700 on a single side face 702 of a metal computing device 701. A feed structure 704 connects a radio 706 to an elongated metal arm 708 formed along an edge of the side face 702 by a cut-out 710 and a notch 712. A plastic insert (not shown) can fit into the cut-out 710 and notch 712. In this configuration, rigidity of the metal computing device 701 can be improve, with a possible trade-off in performance.

In an alternative implementation, the insert may be made from a dielectric material having a dielectric constant that can be altered by applying a voltage to the insert, thereby tuning the resonance frequency during operation of the computing device.

Figure 8:
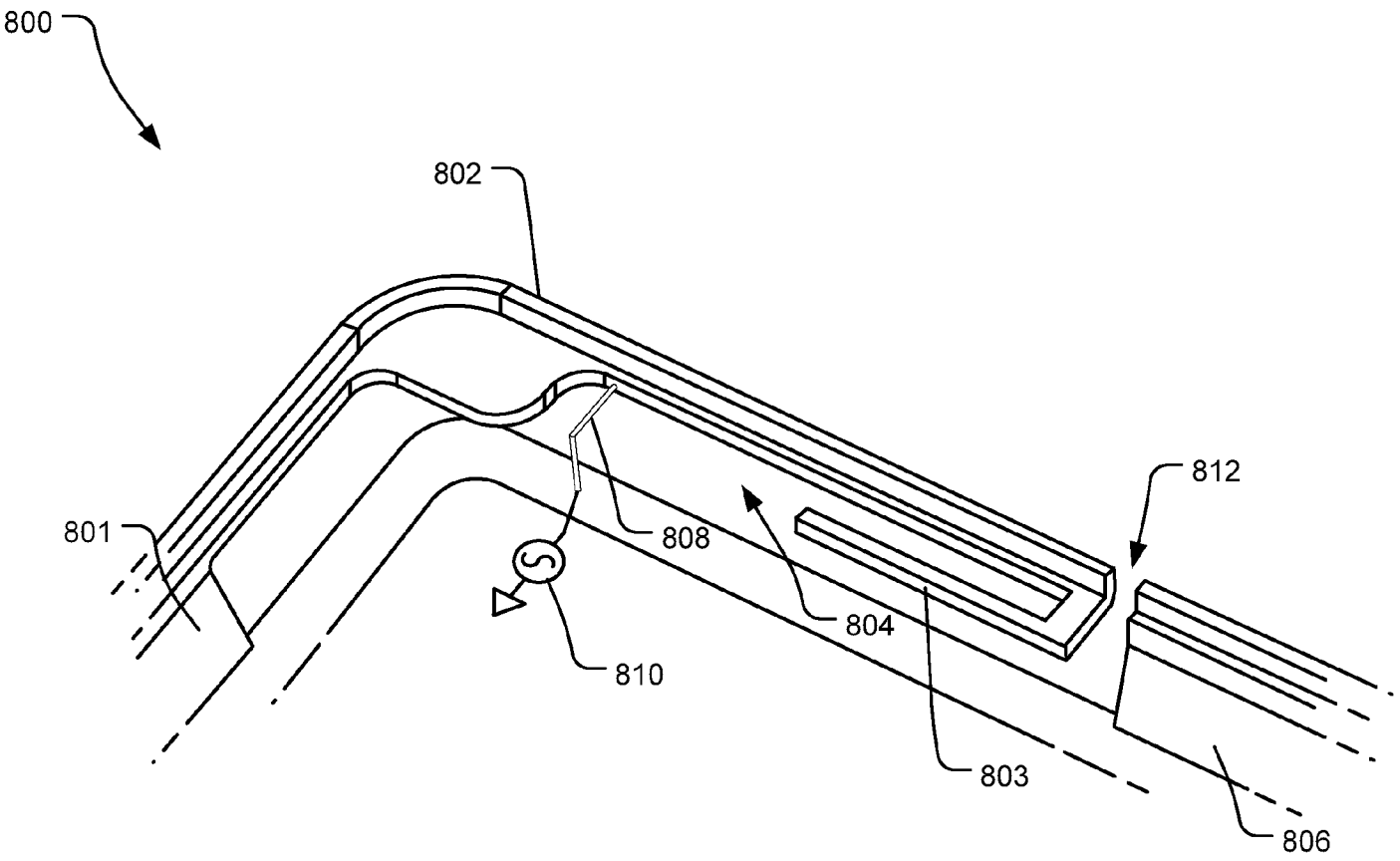
FIG. 8 illustrates an example L-shaped side face antenna assembly with an elongated return arm.

FIG. 8 illustrates an example L-shaped side face antenna assembly 800 with an elongated metal return arm 802 of a metal computing device case 801. The elongated metal return arm 802 includes additional metal material 803 extending the length of the elongated metal return arm 802 while allowing a shorter cut-out 804 in the side face 806 while providing a longer electrical length to the elongated metal return arm 802. A feed structure 808 connects a radio 810 to the elongated metal return arm 802 formed along an edge of the side face 806 by the cut-out 804 and a notch 812.

Slots may also have irregular and/or irregular shapes. For example, slots may be shaped to follow the curves of a rounded corner or other feature of a metal computing device case.

Figure 9:
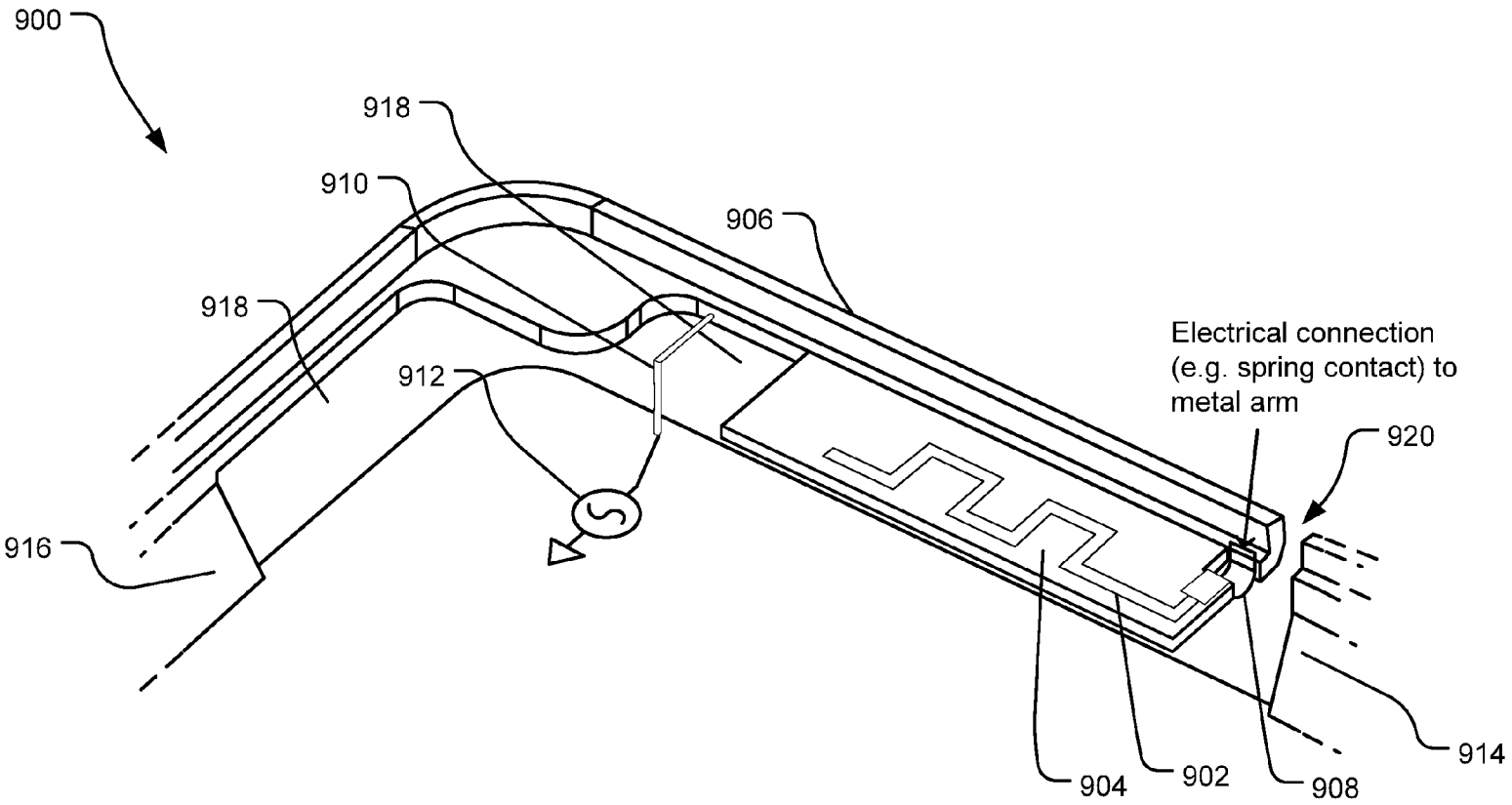
FIG. 9 illustrates an example L-shaped side face antenna assembly with an elongated return trace formed from a separate assembly.

FIG. 9 illustrates an example L-shaped side face antenna assembly 900 with an elongated return trace 902 formed from a separate assembly. The elongated return trace 902 is a conductive trace formed on a printed circuit board (PCB) 904 and electrically connected to an elongated metal arm 906 of the L-shaped side face antenna assembly 900 by an electrical connection interface 908. This configuration allows the frequency response of the L-shaped side face antenna assembly 900 to be tuned long after a metal computing device case has been design and/or manufactured. Rather than depending exclusively on the structure of the metal computing device case, the tuning can be refined later by connecting the elongated return trace 902 to the elongated metal arm 906. The conductive trace may include various conductive metals such as copper, aluminum, etc. A feed structure 910 connects a radio 912 to the elongated metal return arm 906 formed along an edge of the side faces 914 and 916 by the cut-out 918 and a notch 920.

Figure 10B:
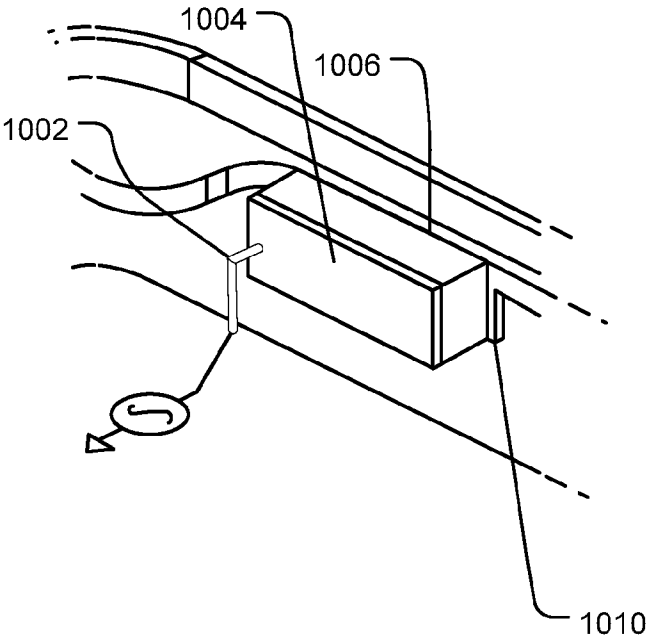
FIGS. 10A and 10B illustrate an example L-shaped side face antenna assembly with a feed structure connected to a metalized surface on a dielectric spacer block.
Figure 10A:
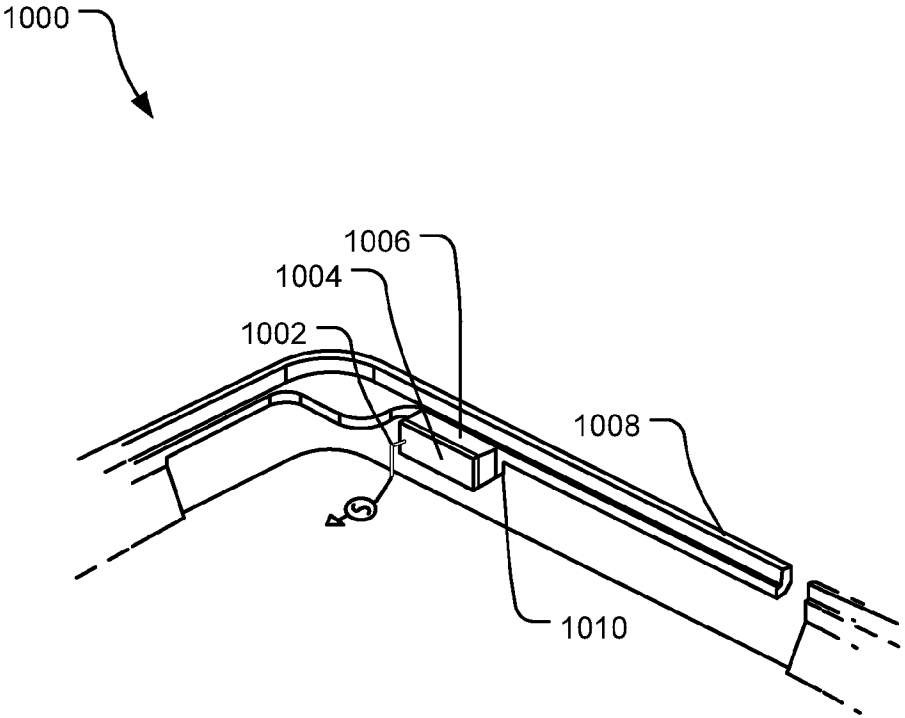

FIGS. 10A and 10B illustrate an example L-shaped side face antenna assembly 1000 with a feed structure 1002 connected to a metalized surface 1004 on a dielectric spacer block 1006. Typically the permittivity of the dielectric material is in the range 10 to 100, although this range may be broader in some applications. An elongated metal arm 1008 of the L-shaped side face antenna assembly 1000 is excited through the block of the insulating dielectric spacer block 1006, allowing an increase in the bandwidth of the L-shaped side face antenna assembly 1000. Another metalized surface 1010 is fixed to the opposite side of the insulating dielectric block spacer 1006 on the elongated metal arm 1008.

Figure 11B:
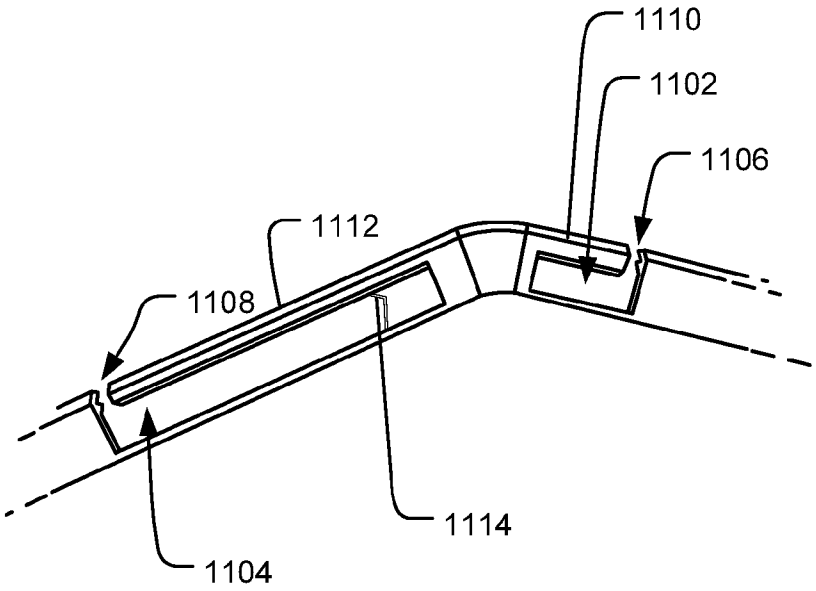
FIGS. 11A and 11B illustrate an example side face antenna assembly having two side face cut-outs and two side face notches.
Figure 11A:
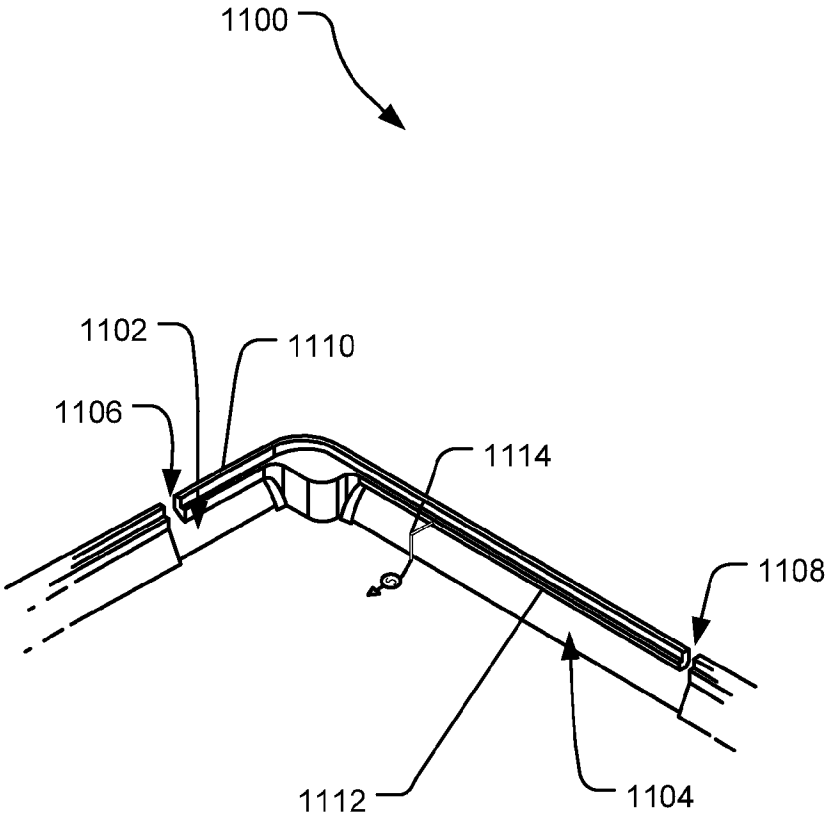

FIGS. 11A and 11B illustrate an example side face antenna assembly 1100 having two side face cut-outs 1102 and 1104 and two side face notches 1106 and 1108. Accordingly, the side face antenna assembly 1100 provides two elongated metal arms 1110 and 1112 that can be tuned to resonate at different frequencies, wherein the arm 1110 is parasitically exited by the arm 1112 when excited, increasing the number of frequencies covered by the side face antenna assembly 1100 via a single feeding connection 1114.

Figure 12B:
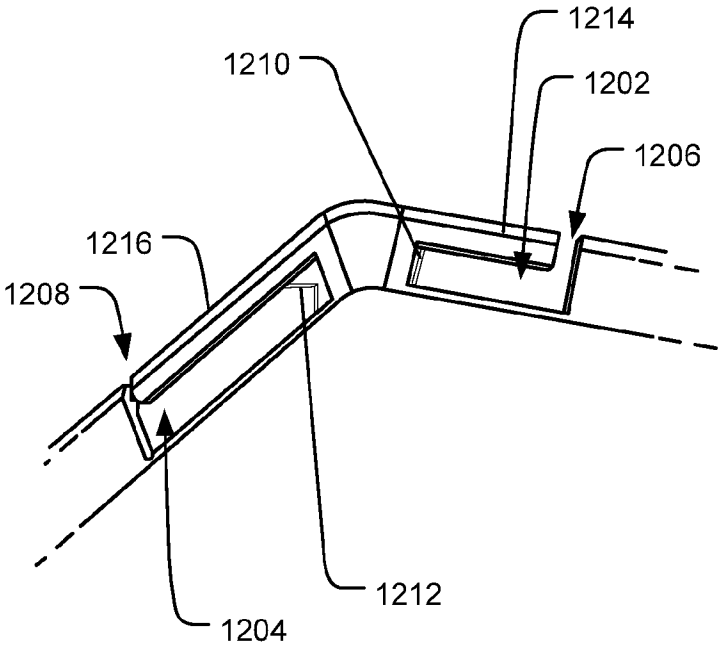
FIGS. 12A and 12B illustrate an example side face antenna assembly having two side face cut-outs, two side face notches, and two feed connections.
Figure 12A:
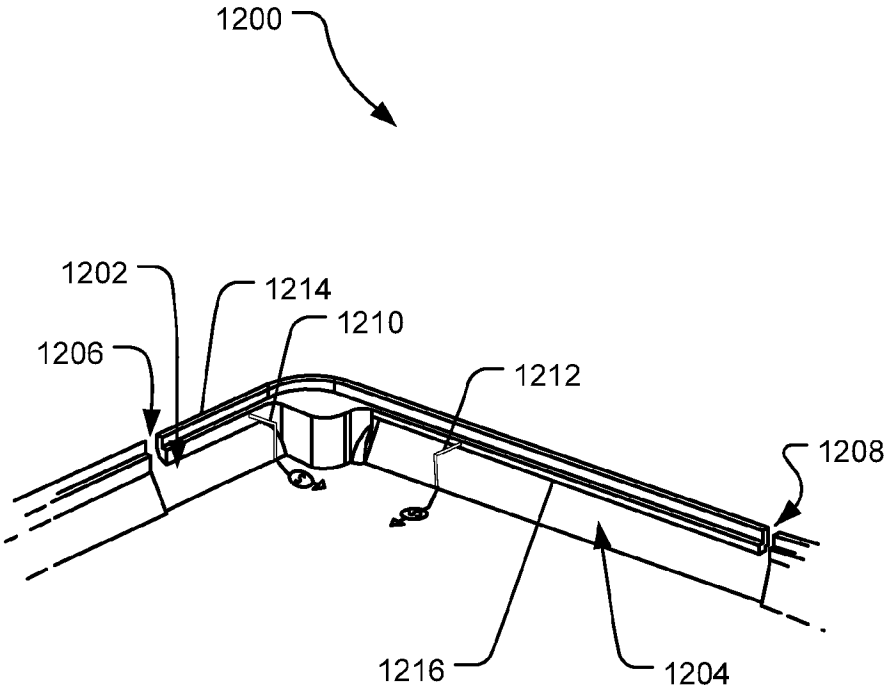

FIGS. 12A and 12B illustrate an example side face antenna assembly 1200 having two side face cut-outs 1202 and 1204, two side face notches 1206 and 1208, and two feed connections 1210 and 1212. Accordingly, the side face antenna assembly 1200 provides two elongated metal arms 1214 and 1216 that can be tuned to resonate at different frequencies, increasing the number of frequencies covered by the side face antenna assembly 1200 via a the two feeding connections 1210 and 1212.

Figure 13:
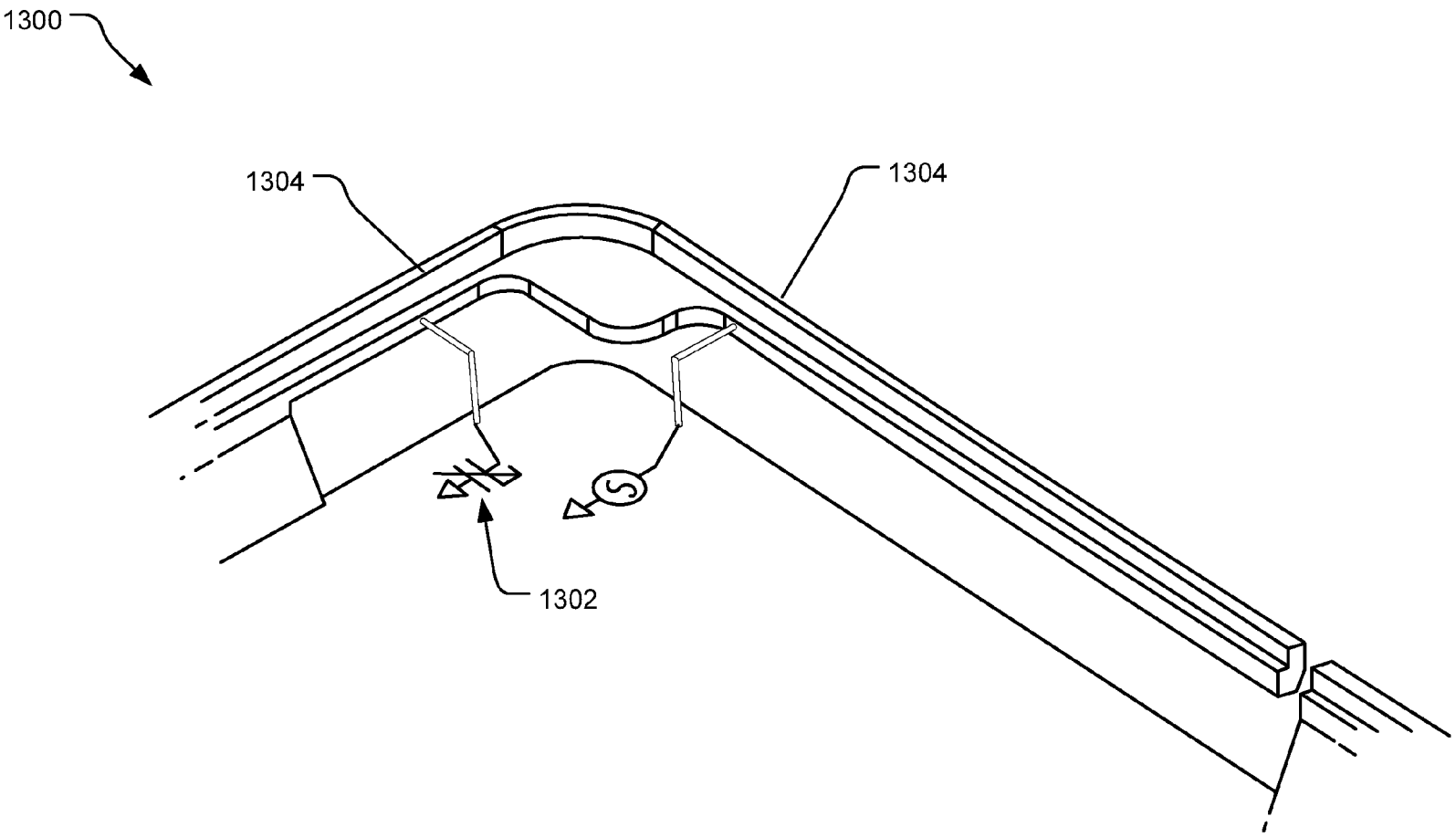
FIG. 13 illustrates an example L-shaped side face antenna assembly having an electronically variable component to change the electrical length of an antenna arm.

FIG. 13 illustrates an example L-shaped side face antenna assembly 1300 having an electronically variable component 1302 to change the electrical length of an antenna arm (e.g., elongated metal arm 1304). The electrically variable component can be inserted across the slot to electronically change the resonant frequency of the elongated metal arm 1304. The electronically variable component 1302 may be in the form of a varicap (e.g., BST capacitor), a MEMS capacitor, an RF switch that commutes between inductors and capacitors of difference values, etc.

Figure 14:
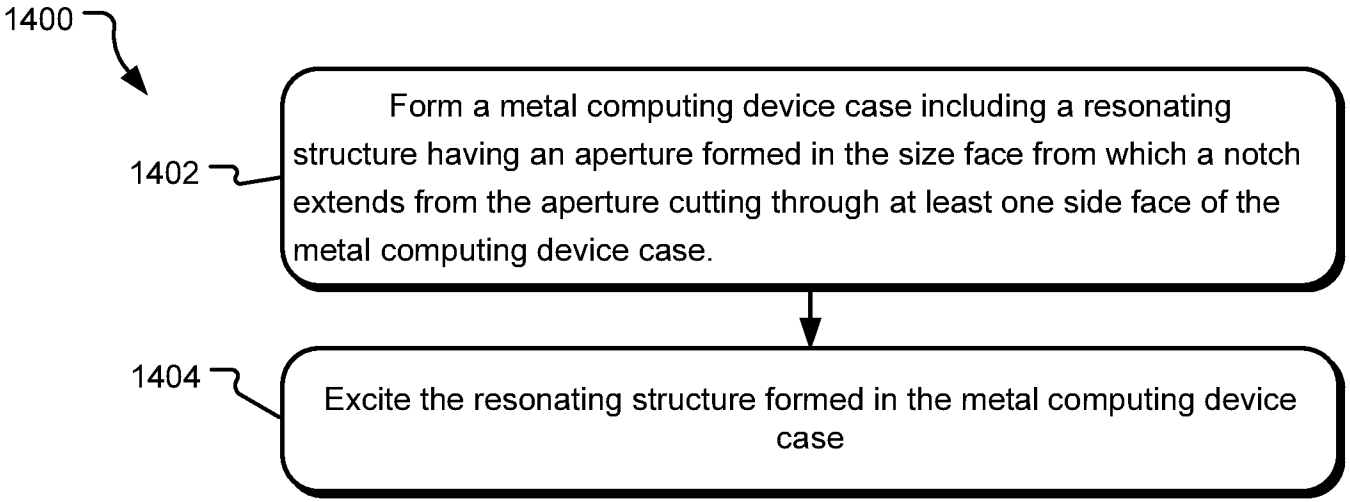
FIG. 14 illustrates example operations for using a side face antenna assembly.

FIG. 14 illustrates example operations 1400 for using a side face antenna assembly. A providing operation 1402 provides a metal computing device case including a back face and one or more side faces bounding at least a portion of the back face. The metal computing device case further includes a radiating structure having an aperture formed in the side face from which a notch extends from the aperture cutting through at least one side face of the metal computing device case.

An exciting operation 1404 excites the radiating structure in the metal computing device case causing the radiating structure to resonate at one or more resonance frequencies over time.

The operations making up the implementations described herein may be referred to variously as operations, steps, objects, or modules. Furthermore, it should be understood that operations may be performed in any order, unless explicitly claimed otherwise or a specific order is inherently necessitated by the claim language.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. An antenna assembly comprising:

a metal computing device case including a back face and one or more side faces bounding at least a portion of the back face, the metal computing device case further including a radiating structure having an aperture formed in at least one side face from which a notch extends from the aperture and cuts through an edge portion of the at least one side face of the metal computing device case, the radiating structure further including the edge portion of the at least one side face and an edge portion of at least another side face of the metal computing device case.

2. The antenna assembly of claim 1 wherein the radiating structure further comprises:

one or more portions of the metal computing device case forming antenna arms proximal to the aperture.

3. The antenna assembly of claim 1 wherein the edge portion of the at least one side face of the metal computing device case is separated from the rest of the side face by the notch.

4. The antenna assembly of claim 1 further comprising:

a conductive feed structure connected to a radio, the conductive feed structure being connected to the radiating structure of the metal computing device case and configured to excite the radiating structure at one or more resonance frequencies.

5. The antenna assembly of claim 4 wherein the conductive feed structure galvanically connects the radio to the metal computing device case.

6. The antenna assembly of claim 4 wherein the conductive feed structure capacitively couples the radio to the metal computing device case.

7. The antenna assembly of claim 4 wherein the conductive feed structure capacitively couples the radio to the metal computing device case through a dielectric spacer.

8. The antenna assembly of claim 1 further comprising:

a conductive feed structure connected to a radio, the conductive feed structure being positioned proximal to the radiating structure of the metal computing device case and configured to excite the radiating structure at one or more resonance frequencies.

9. The antenna assembly of claim 1 wherein a second notch extends from the aperture cutting through an edge portion of a side face of the metal computing device case.

10. The antenna assembly of claim 1 further comprising:

an electronically variable component positioned at the aperture to change the electrical length of an antenna arm formed from a portion of the metal computing device case proximal to the aperture.

11. The antenna assembly of claim 10 wherein the electronically variable component includes a dielectric material having a voltage-dependent dielectric constant.

12. The antenna assembly of claim 11 wherein the dielectric material forms an insert filling the aperture.

13. The antenna assembly of claim 1 wherein the aperture is formed from at least one meandering routed cut-out in the back face of the metal computing device case.

14. The antenna assembly of claim 1 further comprising:

a metallic routing electrically connected to the metal computing device case extending the electrical length of an antenna arm formed from a portion of the metal computing device case proximal to the aperture.

15. The antenna assembly of claim 1, wherein the notch is formed in the at least one side face of the metal computing device case.

16. The antenna assembly of claim 1, wherein the apeture forms an opeing extending completely through the at least one side face of the metal computing device case.

17. A method comprising:

forming a metal computing device case including a back face and one or more side faces bounding at least a portion of the back face, the metal computing device case including a radiating structure having an aperture formed in at least one side face from which a notch extends from the aperture and cuts through an edge portion of the at least one side face of the metal computing device case, wherein the radiating structure further includes the edge portion of the at least one side face and an edge portion of another side face of the metal computing device case.

18. The method of claim 15 wherein the radiating structure further comprises:

one or more portions of the metal computing device case forming antenna arms proximal to the aperture.

19. The method of claim 17 wherein the edge portion of the at least one side face of the metal computing device case is separated from the rest of the side face by the notch.

20. A method comprising:

exciting a radiating structure formed in a metal computing device case, the metal computing device case including a back face and one or more side faces bounding at least a portion of the back face, the radiating structure having an aperture formed in at least one face of the metal computing device case from which a notch extends from the aperture and cuts through an edge portion of at least one side face of the metal computing device case, wherein the radiating structure further includes the edge portion of the at least one side face and an edge portion of another side face of the metal computing device case.

* * * * *